US005305913A

United States Patent [19]

Shade

[11] Patent Number: 5,305,913

[45] Date of Patent: Apr. 26, 1994

[54] APPARATUS FOR DISPENSING ARTICLES

[76] Inventor: Michael W. Shade, 7801 Dock Rd., #7, Egg Harbor, Wis. 54209

[21] Appl. No.: 43,199

[22] Filed: Apr. 5, 1993

Related U.S. Application Data

[63] Continuation-in-part of Ser. No. 901,767, Jun. 19, 1992, Pat. No. 5,199,599.

[51] Int. Cl.[5] ..... B65H 1/08

[52] U.S. Cl. ..... 221/226; 221/231; 221/241; 221/253; 221/285; 221/155

[58] Field of Search ..... 221/151, 152, 155, 224, 221/226, 228, 231, 235, 237, 241, 242, 244, 245, 253, 285, 304

[56] References Cited

U.S. PATENT DOCUMENTS

| | | | |
|---|---|---|---|
| 1,621,960 | 3/1927 | Stewart et al. | 221/304 X |
| 2,010,373 | 8/1935 | Pinkenburg | 221/241 X |
| 2,396,411 | 3/1946 | Cameron | 221/231 X |
| 3,705,665 | 12/1972 | Gunzler | 221/188 |
| 3,957,175 | 5/1976 | Gordon | 221/215 |
| 3,960,291 | 6/1976 | Navi | 221/36 |
| 4,008,828 | 2/1977 | Branchaud | 221/241 |
| 4,139,120 | 2/1979 | Moore | 221/213 |
| 4,140,242 | 2/1979 | Muller et al. | 221/154 |
| 4,174,047 | 11/1979 | Owens | 221/154 |
| 4,258,861 | 3/1981 | Traill et al. | 221/213 |
| 4,298,140 | 11/1981 | Owens | 221/232 |
| 4,299,335 | 11/1981 | Osterman | 221/241 |
| 4,319,695 | 3/1982 | Dutro | 221/213 |
| 4,331,261 | 5/1982 | Brown | 221/232 |
| 4,413,749 | 11/1983 | Glaser | 221/1 |
| 4,418,836 | 12/1983 | Christian | 221/37 |
| 4,428,503 | 1/1984 | Martin | 221/232 |
| 4,469,246 | 9/1984 | Albright et al. | 221/225 |
| 4,473,172 | 9/1984 | Reynolds | 221/213 |
| 4,496,074 | 1/1985 | Owens | 221/39 |
| 4,508,238 | 4/1985 | Johnson et al. | 221/107 |
| 4,530,444 | 7/1985 | Christian | 221/37 |
| 4,558,803 | 12/1985 | Draper et al. | 221/229 |
| 4,566,608 | 1/1986 | Draper et al. | 221/229 |
| 4,569,461 | 2/1986 | Orr | 221/1 |
| 4,583,658 | 4/1986 | Israel | 221/213 |
| 4,625,894 | 12/1986 | James et al. | 221/193 |
| 4,651,896 | 3/1987 | Harrell | 221/229 |
| 4,654,513 | 3/1987 | Hennessy | 235/381 |
| 4,655,369 | 4/1987 | Gabriel | 221/213 |
| 4,667,803 | 5/1987 | Gordon | 194/248 |
| 4,700,869 | 10/1987 | Bogner | 221/229 |
| 4,802,606 | 2/1989 | Daniels | 221/39 |
| 4,865,178 | 9/1989 | Lewandowski | 194/227 |
| 4,875,598 | 10/1989 | Dahl | 221/4 |

*Primary Examiner*—D. Glenn Dayoan
*Assistant Examiner*—Dean A. Reichard
*Attorney, Agent, or Firm*—Godfrey & Kahn

[57] ABSTRACT

A dispensing apparatus is disclosed for sequentially vending articles upon movement of an actuator. The dispensing apparatus includes a platform for supporting the articles to be vended; a display assembly disposed adjacent to the platform; a forward support assembly disposed between the platform and the display assembly and wherein the forward support assembly is biased in the direction of the display assembly and wherein a single article to be vended is disposed in sandwiched relation between the display assembly and the forward support assembly; a rearward support assembly is slidably mounted above the platform and operable to urge the articles along the platform; a carriage assembly is movably borne by the platform; a metering assembly is pivotally mounted on the carriage assembly and operable for movement along a path of travel from a first position, wherein the metering assembly substantially inhibits movement of the articles along the platform, to a second position, wherein the metering assembly permits the articles to advance along the platform; a movement limiting member disposed in movement impeding relation relative to the metering assembly, and wherein the movement limiting member permits the metering assembly to travel increasing distances along the path of travel as the thickness of the article to be vended increases; and a drive assembly disposed in force receiving relation relative to the actuator and in forced transmitting relation relative to the rearward support assembly, and the metering assembly, respectively, the drive assembly under the influence of the actuator simultaneously urging the rearward support assembly along the platform and the metering assembly from the first to the second position thereby vending a single article.

12 Claims, 9 Drawing Sheets

APPARATUS FOR DISPENSING ARTICLES

The present application is a continuation in part of patent application Ser. No. 07/901,767 and which was filed on Jun. 19, 1992, now U.S. Pat. No. 5,199,599 dated Apr. 6, 1993.

FIELD OF THE INVENTION

The present invention relates generally to an apparatus for dispensing articles, such as newspapers and the like, and more particularly, to a coin-operated newspaper dispensing apparatus in which the newspapers are individually and sequentially dispensed upon insertion of the proper coinage.

DESCRIPTION OF THE PRIOR ART

The typical street corner newspaper dispenser includes a metal box which holds a vertical stack of newspapers, and a front door which can be opened when the proper combination of coins are inserted thereby permitting access to the newspapers. Once the front door is opened, however, the purchaser has access to the entire stack of newspapers. It is presumed under most instances, that a purchaser has a need for only one newspaper.

Unfortunately, this system of vending newspapers is defenseless against unscrupulous individuals who, on occasion, insert the necessary coinage to obtain a single paper, but who subsequently remove the entire stack, and thereafter sell the individual papers at their own considerable profit. Moreover, and during times of unpredictable weather, such as a sudden thunderstorm, the corner newspaper dispenser often serves as an expedient "umbrella" dispenser whereby a single customer inserts the necessary coinage to unlock the door, however, surrounding persons take additional papers to and use them for protection from the elements. In addition to the foregoing, newspapers are often stolen for other purposes, such as, for example, to provide an insulative lining for the clothes, and bedding for the homeless, and combustible fuel for make-shift corner heaters during the winter months. Under these circumstances it is not surprising that street corner newspaper dispensers currently suffer a loss rate of up to 40%.

The prior art is replete with assorted dispensing apparatuses and other assemblies for vending newspapers. For example, such devices include complex dispensing systems which are powered by assorted levers, biasing springs, sophisticated cam assemblies and complex gear arrangements to individually dispense single newspapers or other similar rectangular shaped, or generally parallel-piped objects. However, and while widely diverse in construction and operation, these same prior art dispensers of newspapers are also replete with a multiplicity of deficiencies and other shortcomings which have detracted from their usefulness.

Foremost among the deficiencies of the prior art single vend newspaper dispensers is the daily adjustments or steps which must often occur to prepare these same dispensers for operation. More particularly, it should be understood that the thickness of a daily newspaper varies from day to day, for example, a Monday edition of a newspaper has a thickness dimension which is invariably less than a Sunday edition which normally contains a variety of weekly magazines, television guides, and numerous coupons. Due, of course, to the wide range of thicknesses in which newspapers may be published and because these prior art dispensers lack a convenient means for quickly accommodating newspapers having these assorted thicknesses, newspaper delivery personnel are often confronted with the time-consuming and sometimes difficult task of individually adjusting or preparing numerous newspaper dispensers for that day's edition. For example, U.S. Pat. No. 3,960,291 teaches that newspapers must be painstakingly oriented within the dispensing machine in an overlapping and alternating arrangement. Additionally, U.S. Pat. No. 4,008,828 teaches that the newspaper dispenser must be manually adjusted for each daily newspaper edition which is placed therein, and such adjustment is accomplished by manipulating a nut and lever assembly. As should be readily apparent, these manual adjustments, and preparations unduly delays the delivery of newspapers which results in cost increases, and employee frustration and fatigue.

The prior art also discloses numerous devices and assemblies for addressing the aforementioned problems. Pertinent prior art references include, but are not limited to, U.S. Pat. Nos. 4,139,120; 4,174,047; and 4,258,861 to name but a few.

Another deficiency of the prior art dispensing machines is that they are typically quite complex in design which correspondingly significantly increases the likelihood that these dispensing machines will fail, jam, or otherwise experience malfunction during operation following exposure to the outside environment, and which further may include harsh physical treatment from the typical consumer and delivery person. Moreover, the complex design of these prior art dispensing machines increases the attendant manufacturing and maintenance costs for these same devices.

Yet another deficiency with the prior art newspaper vending dispensers relates to the difficulty of reading the display copy of the newspaper. More particularly, a typical newspaper dispensing machine includes a transparent front door which is low to the ground, and which is substantially vertically oriented such that a potential purchaser of a newspaper must bend down to an often awkward position to look in the door and read the headlines of the display copy. This results in undue consumer inconvenience.

Therefore, it has long been known that it would be desirable to have a newspaper vending apparatus that dispenses one issue of a newspaper, or the like, at a time, is simple, efficient, and durable in design, and which further addresses the deficiencies attendant with the prior art devices, and practices.

OBJECTS AND SUMMARY OF THE INVENTION

Therefore, it is an object of the present invention to provide an improved apparatus for dispensing articles, such as newspapers and the like.

Another object of the present invention is to provide such an apparatus which is operable to obtain the individual benefits to be derived from related prior art apparatuses and practices while avoiding the detriments individually associated therewith.

Another object of the present invention is to provide an apparatus for dispensing articles such as newspapers, magazines and other articles of similar shape, and which is simple in construction, reliable in operation, and which further effectively inhibits or substantially impedes the unauthorized removal of the individual newspapers without a corresponding payment.

Another object of the present invention is to provide an apparatus for dispensing articles which is free of problematic mechanical arrangements and which further includes simple and inexpensive subassemblies, and which additionally is manually operated.

It is a further object of the present invention to provide an apparatus for dispensing articles, such as newspapers, which employs a simple, reliable, but nevertheless accurate and efficient adjustment assembly for reliably and sequentially dispensing newspapers of different thicknesses.

A further object of the present invention is to provide an apparatus for dispensing articles, such as newspapers, which does not damage, tear, rip or otherwise perforate the individual newspapers during vending thereof.

A further object of the present invention is to provide such an apparatus for dispensing articles which is easily assembled and constructed of inexpensive subassemblies, and which further has a rugged, long lasting, relatively damage proof construction.

A further object of the present invention is to provide an apparatus for dispensing articles, such as newspapers, which does not require newspaper stack alteration or reconfiguration, and which further does not require other time consuming preparation of the newspapers prior to their being loaded into the apparatus.

Another object of the present invention is to provide an apparatus for dispensing articles such as newspapers and the like and which permits a customer to easily view a display copy thereof.

Another object of the present invention is to provide an apparatus which substantially eliminates pilferage or theft of the articles by dishonest customers.

Yet another object of the present invention is to provide a single-vend article dispenser for newspapers, and the like, and which will support a large number of newspapers so as to be competitive with non-single vend machines which are utilized for substantially identical purposes.

Further objects and advantages of the present invention are to provide improved elements and arrangements thereof in an apparatus for the purposes described which is dependable, economical, durable and fully effective in accomplishing its intended purposes.

These and other objects and advantages are achieved in an apparatus for dispensing articles such as newspapers and the like and which includes a housing which encloses the newspapers, the housing having a passageway which permits individual newspapers to exit the housing; a platform disposed within the housing, and which is operable for supporting the newspapers within the housing; a rearward support assembly mounted for movement along a first path of travel, the rearward support assembly being operable to urge the newspapers toward the passageway; a forward support assembly borne by the housing and operable to position a newspaper in an appropriate orientation for viewing from a position outside the housing; a carriage assembly slidably mounted within the housing and operable for movement along a predetermined, second path of travel; a metering assembly mounted for pivotable movement on the carriage assembly and operable for movement along a third path of travel, from a first position, wherein the metering assembly is disposed in occluding relation relative to the passageway whereby it substantially inhibits forward movement of the newspapers relative to the passageway, to a second position, wherein the metering assembly is disposed in a substantially non-occluding position relative to the passageway thereby permitting the newspapers to move in the direction of the passageway; an actuator borne by the housing and which is operable for movement along a fourth path of travel from a first, non-vend position, to a second, vend position; a movement limiting member disposed in movement impeding relation relative to the metering assembly; and a drive assembly disposed in force receiving relation relative to the actuator, and which is operable simultaneously to drive the metering assembly along the third path of travel from the first, partially occluding position, to the second, non-occluding position, and drive the rearward support assembly toward the passageway thereby vending a single article.

DETAILED DESCRIPTION OF THE PREFERRED EMBODIMENT

Figure 2:
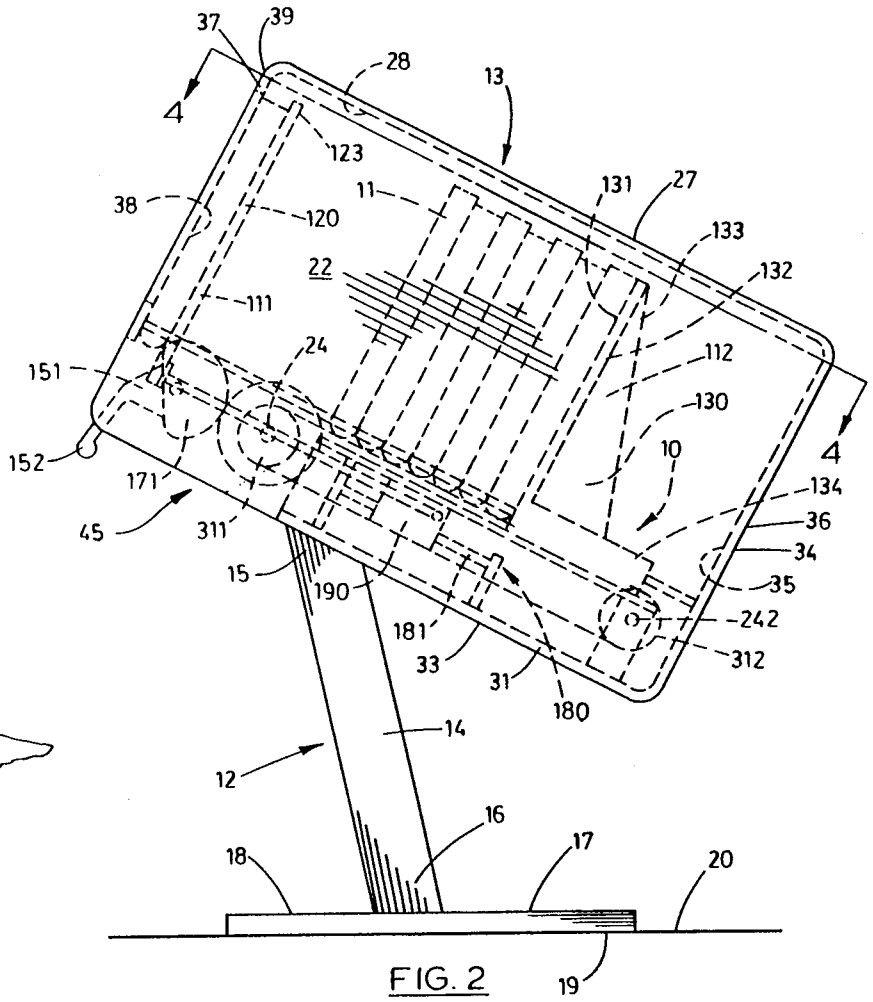
FIG. 2 is a right side elevational view of the apparatus of the subject invention shown in FIG. 1 with some underlying structures shown in phantom lines.
Figure 1:
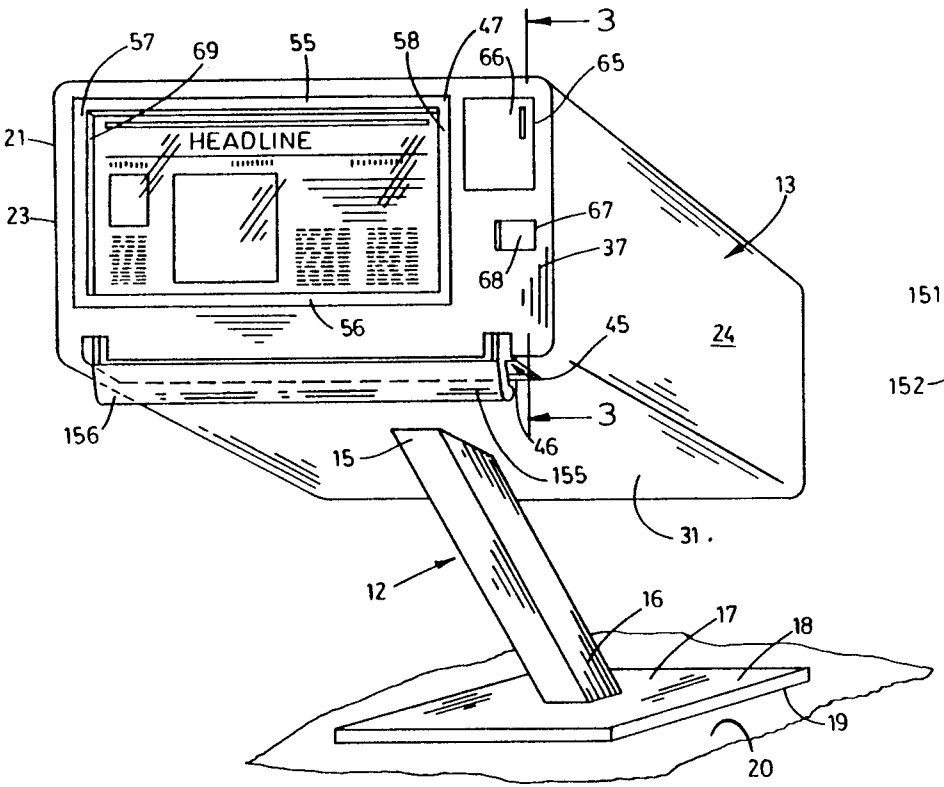
FIG. 1 is a perspective, environmental view of the apparatus of the subject invention shown in a typical operative configuration.

Referring more particularly to the drawings, the apparatus of the subject invention is generally indicated by the numeral 10 in FIGS. 1 and 2. As shown therein, the apparatus 10 is operable to enclose and dispense a plurality of articles, one at a time, such as newspapers 11, magazines, or similar substantially identically shaped objects.

The newspapers 11 are individually defined by predetermined length, width and thickness dimensions and further include a folded edge portion 11A. As best illustrated, in FIGS. 1 and 2, the apparatus includes a support assembly which is generally indicated by the numeral 12, and a housing 13. The support assembly includes a post member 14 having a first end 15, and a second end 16; and a platform member 17 having a top surface 18 and bottom surface 19. The first end 15 is made integral with the housing, and the second end 16 is made integral with the top surface 18 of the platform member. The joint between the first end 15, and the housing will be described in further detail hereinafter. Further, the bottom surface 19 of the platform member is disposed in resting engagement on the surface of the earth 20 thereby supporting the housing in an appropriate orientation for operation.

As best illustrated by reference to FIGS. 3 and 4, the housing 13 is substantially rectangularly shaped, and is defined by a left panel 21 having an interior facing surface 22 and an exterior facing surface 23; a right panel 24 having an interior facing surface 25 and an exterior facing surface 26; a roof panel 27 having an interior facing surface 28 and an exterior facing surface 29; a floor panel 31 having an interior facing surface 32 and an exterior facing surface 33; a rear panel 34 having an interior facing surface 35 and an exterior facing surface 36; and a door or display assembly 37 having an interior facing surface 38 and an exterior facing surface 39. A housing cavity, and which is generally indicated by the numeral 40, within which the newspapers 11 are enclosed, is defined by the interior facing surfaces 22, 25, 28, 32, 35, and 38, respectively. Further, the housing 13 has a forward portion 41, and a rearward portion 42.

Figure 5:
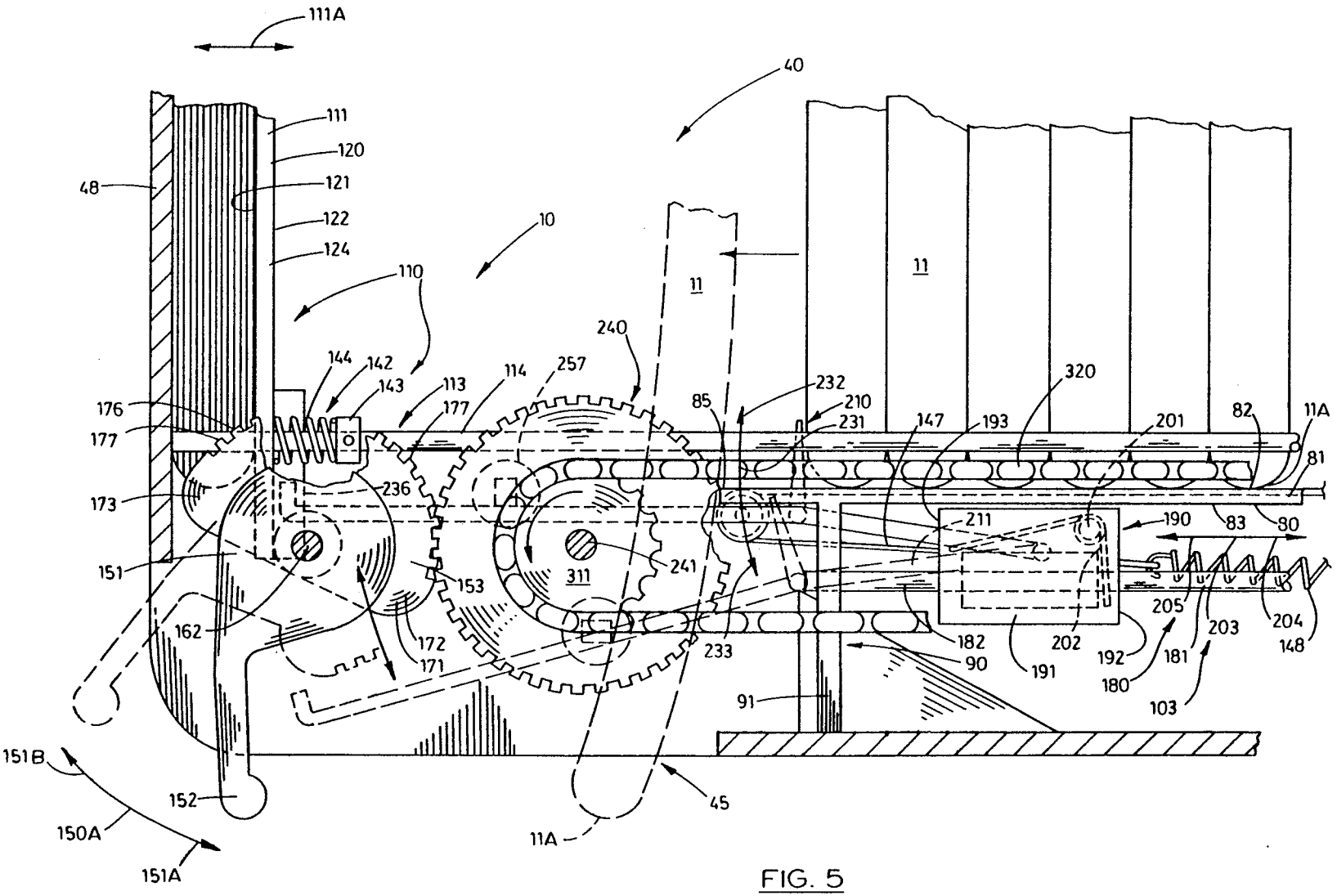
FIG. 5 is a fragmentary, vertical, sectional view of the apparatus of the subject invention and which is taken from a position along line 5—5 of FIG. 4.

As best seen by reference to FIG. 1 and FIG. 5, the floor panel 31 has formed therein a passageway 45 which is substantially rectangularly shaped and which is defined by a peripheral edge 46. As should be understood, the passageway 45 is defined by a length dimension which is greater than the width of the newspaper 11, and is further defined by a width dimension which is greater than the thickness dimension of the newspaper thereby permitting individual newspapers to exit or pass from the housing cavity 40 to the outside environment during operation of the apparatus 10.

As best illustrated by reference to FIGS. 1, 3 and 4, the door or display assembly 37 includes a panel member or support frame 47; and a transparent panel, or viewing means 48 which may be manufactured from tempered glass, synthetic polymeric materials or other similarly suitable, rigid, yet transparent materials. The panel member or support frame is substantially rectangularly shaped and is defined by a top portion 55, an opposite bottom portion 56, and left and right sides, 57 and 58, respectively. Formed in predetermined positions in the panel member 47 are a plurality of apertures, namely a first aperture 65 which permits access to a coin deposit assembly, or holder 66; a second aperture 67, which permits access to a coin return box 68; and a third aperture 69 which is operable to receive the transparent panel or viewing means 48. As should be understood, the transparent panel or viewing means 48 is secured on the panel member 47, and within the aperture 69, by methods which are common knowledge in the industry, such as, for example, by employing suitable adhesives or caulking materials or by employing any number of fastening devices. In addition to the foregoing, the display assembly 37 is releasably engageable with the housing in such a fashion so as to permit access to the interior housing cavity 40, such as to service the apparatus 10, or to resupply the apparatus with additional newspapers 11. This operational characteristic of the display assembly will be explained in further detail in the paragraphs which follow. It is additionally anticipated that the interior housing cavity of the apparatus may be accessed by way of the roof panel 27. The display assembly would be secured to the housing by means of a lock, not shown.

As best seen by reference to FIGS. 1 and 2, the housing 13 is mounted in an angled or non-perpendicular relationship relative to the support assembly 12. More particularly, the exterior surface 33 of the floor panel 31 is made integral with, or fastened on the first end 15 of the post member 14 in such a fashion that the display assembly 37 and more particularly, the forward portion 41 of the housing are each oriented upwardly and in angled relationship relative to the surface of the earth 20. As should be readily apparent, this angled orientation between the housing and the post member permits a consumer or passerby to easily read a displayed newspaper 11 without changing their body position as compared with the relative difficulty associated with reading a display newspaper in a typical newspaper vending device which is located low to the ground, and which includes a substantially vertical display assembly.

As most clearly illustrated by reference to FIGS. 3 and 9, the apparatus 10 includes a platform which is generally indicated by the numeral 80, and which includes a main body 81 having a predetermined shape and which is operable to support the plurality of newspapers 11. The main body 81, has a top surface 82, an opposite bottom surface 83, a first end 84 and an opposite second end 85. The main body 81 is disposed in spaced relationship relative to the floor panel 31 by a plurality of supporting legs which are generally indicated by the numeral 90. The supporting legs include first, second, third and fourth legs 91, 92, 93 and 94, respectively. As best illustrated by reference to FIGS. 4 and 9, metering apertures 100 are formed in the main body 81. Each of the metering apertures have predetermined length and width dimensions, and extend from the second end 85 towards the first end 84 of the platform. The platform 80 further has a major axis 101; and a minor axis 102 which is disposed in substantially normal relation relative thereto. A space or cavity 103 is defined between the bottom surface 83 of the main body 81 and the floor panel 31. This is best seen in FIG. 5.

As best illustrated by reference to FIGS. 3 and 5, the folded edge portions 11A of the individual newspapers 11 are supported on the top surface 82. As should be understood, the second end 85 of the platform 80 is oriented in substantial alignment, or in registry with the passageway 45 and therefore a newspaper 11 may easily exit the internal housing cavity 40 through the passageway 45 and under the influence of gravity, once it is urged off of the platform. As should be appreciated, the platform 80 may be movably mounted on the interior facing surface 32 of the floor panel 31 and thereby rendered operable for reciprocal, sliding motion relative to the housing 13. This would, of course, permit servicing or resupply of the apparatus 10 as was discussed earlier. Additionally, and in the instance where the apparatus 10 is resupplied through the roof panel 27, it should be understood that the platform 80 would not be reciprocally moveable. Any number of known sliding support assemblies (not shown) would accommodate such movement of the platform. Accordingly, in a situation where the apparatus 10 requires servicing or resupply of newspapers, the display assembly 37 is pulled from an operational position where it is disposed in the cavity 40 of the housing 13, to a second, servicing position which orients the platform in a location outside of the housing.

Upon completion of servicing and/or resupplying activities, the platform is urged back into the operating position. This is best imaged by a study of FIGS. 1 and 3, respectively. As best illustrated by reference to FIG. 3, the apparatus 10 employs a support frame 110 which includes a forward support assembly 111, and a rearward support assembly 112. The support frame 110 further includes a pair of elongated support beams, shafts or members 113 which have substantially circular cross-sectional shapes. The individual support beams are designated as first and second support beams 114 and 115, respectively. As best seen by reference to FIG. 4, the individual support beams are made integral with, or are fastened onto the display assembly 37 and extend generally normally, rearwardly thereof.

Figure 9:
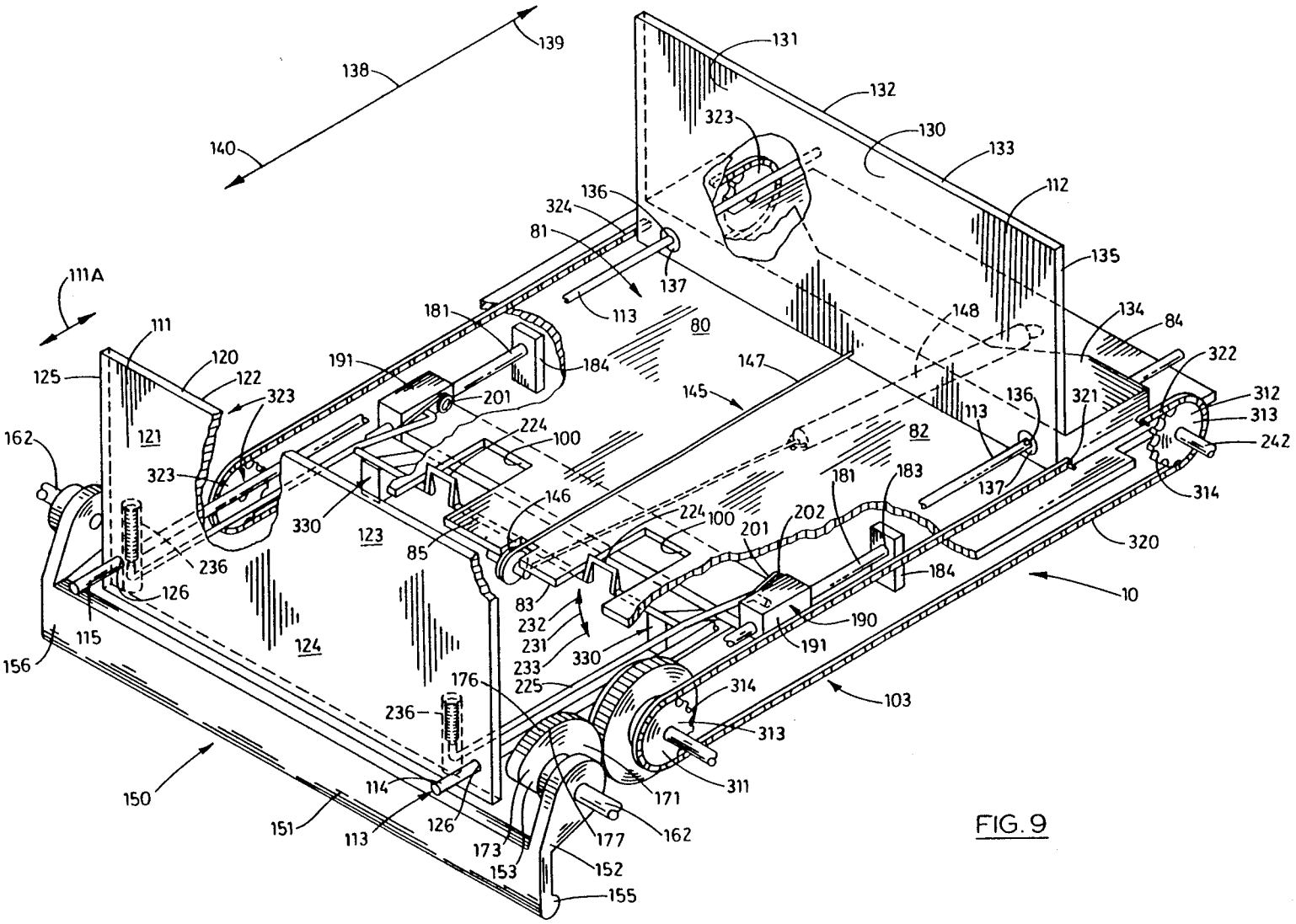
FIG. 9 is a perspective view of the apparatus of the subject invention with many supporting surfaces removed to illustrate the structure thereunder.

As best seen by reference to FIG. 9, the forward support assembly 111 includes a substantially rectangular shaped main body 120 which includes interior and exterior facing surfaces 122 and 123, respectively. Further, the main body 120 includes a top portion 121, an opposite bottom portion 124, and is further defined by peripheral edge 125. A pair of apertures 126 are formed in the main body 120 and are disposed in a predetermined pattern in the bottom portion 124. The apertures are oriented in a normal relationship relative to the interior facing surface 122. The individual apertures are operable to slidably receive the individual support beams 113.

The rearward support assembly 112 includes a main body 130 having a predetermined thickness dimension, and which further includes interior and exterior facing surfaces 131 and 132, respectively. Further, the main body 131 includes a top portion 133, an opposite bottom portion 134, and further is defined by a peripheral edge 135. Additionally, the bottom portion 134 of the rearward support assembly 112 has formed therein a pair of channels 136, which have predetermined diametral dimensions, and which are disposed in a specific pattern to receive the individual support beams 113. Bearings 137 are mounted in the channels 136 and are operable to matingly, and slidably engage each of the support beams 113 thereby rendering the rearward support assembly slidably moveable along the individual beams, and along a path of travel 138 from a first position 139, where the rearward support assembly is positioned in juxtaposed relation relative to the rear panel 34, to a second position 140 wherein the rearward support assembly is located adjacent to the second end 85 of the platform 80. This is best seen in FIG. 9.

As should be understood by reference to FIG. 9, the individual support beams 113 provide a framework upon which the forward and rearward support assemblies 111 and 112, respectively may be slidably mounted for operation. The individual support beams are positioned in substantially parallel, spaced relation one to the other and are otherwise positioned in substantially normal relation relative to the forward and rearward support assemblies. As best illustrated by reference to FIG. 5, the forward support assembly 111 is biasedly mounted for limited rearward travel on the respective support beams 113. More particularly, the forward support assembly is operable for limited, biased travel along a path of travel 111A which is substantially coaxially aligned with the major axis 101. As should be understood, each of the support beams have a biasing assembly 142 mounted thereon, and which includes a washer 143 and a biasing means 144 which is illustrated in the drawings as a coil spring. Each of the washers 143, is fastened on or otherwise made integral with the respective support beams 113. The biasing assemblies 142 are each operable to urge the forward support assembly in the direction of the display assembly 37. During operation, the forward support assembly is operable to position or orient a single newspaper 11 against the interior portion 38 of the display assembly 37 for viewing from a position outside the housing 13. In particular, the forward support assembly is manually moved, rearwardly, along the support frame 110, thereby compressing the individual biasing assemblies 145. When this is achieved, a single newspaper 11 is placed between the interior portion 38 of the display assembly 37 and the exterior facing surface 123 of the forward support assembly 111. Upon placing a newspaper 11 in this position, the forward support assembly is released thereby permitting the individual biasing assemblies 144 to urge the forward support assembly toward the display assembly 37 thus positioning or sandwiching the newspaper therebetween. Of course, the transparent panel 48 permits the newspaper to be read or viewed from a position outside, or exterior to the housing 13.

Figure 4:
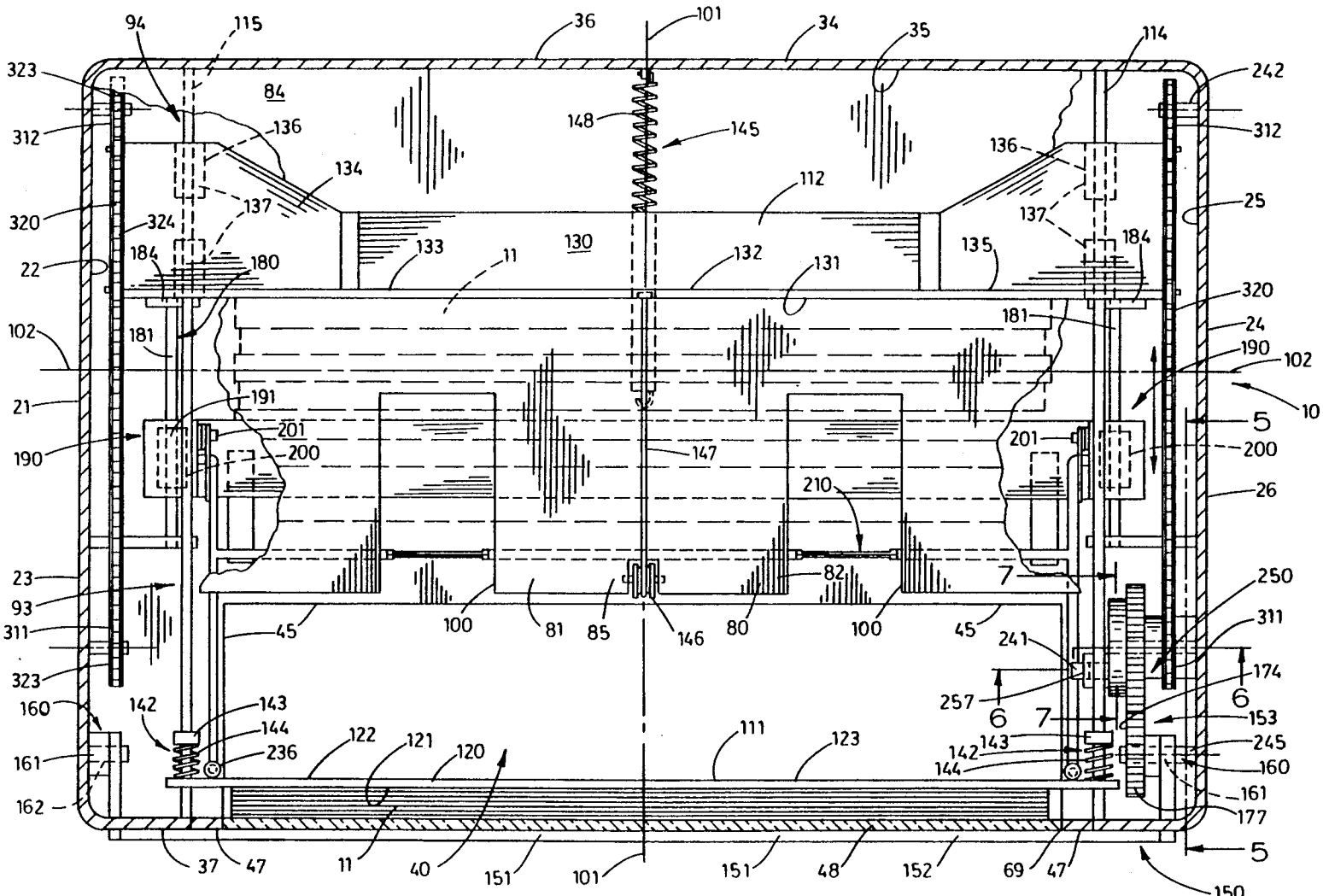
FIG. 4 is a plan view of the apparatus of subject invention which is taken from a position along line 4—4 of FIG. 2 and which has some supporting structures removed to show the detail thereunder.

As best seen by reference to FIGS. 4 and 9, a movement assistance assembly 145 is provided to further propel the newspapers 11 and the rearward support assembly 112 toward the passageway 45. The movement assistance assembly 145 includes a pulley 146 which is rotatably mounted on the second end 85 of the platform 80, and which is operable to receive a cable 147. The cable is fastened at one end to the interior facing surface 131 of the rearward support assembly 112, and the opposite end is fastened on a spring 148. The spring is fastened on the interior facing surface 35 of the rear wall 34 of the housing 13. In operation, the spring 148 maintains force on the cable, and the weight of the newspapers on the cable has the effect of placing additional force on the rearward support assembly thereby assisting its movement along the path of travel 138. Additionally, the cable and spring, in combination, reduce the effect of friction on the newspapers as they slide across the platform 80.

FIGS. 3 through 8, respectively, illustrate an actuator which is generally indicated by the numeral 150. The actuator is defined by a substantially elongated and rotatable main body 151. The actuator further includes a handle portion 152; and a drive portion 153. The main body includes a first end 155; and an opposite second end 156. The main body 151 is rotatably mounted or otherwise borne on the bottom portion 56 of the display panel 47 by conventional mounting methods which are well understood in the industry. For example, and as best illustrated by reference to FIG. 4, a pair of opposite, first and second mounting brackets 161 are fastened on, or otherwise made integral with, the interior facing surface 38 of the display assembly 37. The first and second ends of the main body 151 are respectively rotatably mounted on the first and second mounting brackets, such as, for example by utilizing individual axle members 162 or other similar assemblies. The axle members define the axis of rotation for the actuator. A suitable biasing means (not shown) such as a pair of springs are operable to bias or urge the main body about the axis of rotation in a predetermined counter-clockwise direction as that is viewed from FIG. 3. When the actuator is properly mounted on the display assembly 37, the axis of rotation is oriented substantially parallel to the minor axis 102 of the platform 80. As should be understood, the main body 151 is operable for movement about the axis of rotation which is defined by the axles 162 and along a rotational path of travel 150A from a first, substantially occluding, non-vend position 151A, to a second, substantially non-occluding, vend position 151B. Upon release of the actuator 150, the biasing means which, will normally include a pair of springs (not shown), urges the actuator into the first, non-vend position.

As best seen by reference to FIG. 5, the drive portion 153 of the actuator 150 includes a main body 171, having a first end 172; a second, substantially arcuately shaped end or portion 173; an interior facing surface 174; and an exterior facing surface 175. Further, the main body 171 is defined by a peripheral edge 176. Formed along the peripheral edge 176 of the arcuately shaped second end, or portion 173, are a plurality of substantial equally spaced teeth 177. As should be understood, the teeth 177 are disposed in force transmitting relation relative to a drive assembly which will be explained and described in further detail in the paragraphs which follow.

As best illustrated by reference to FIGS. 3 and 4, a carriage support frame is generally indicated by the numeral 180, and is disposed below, and in predetermined spaced relationship relative to the platform 80 and in the space 103. The carriage support frame includes a pair of support beams 181 which have substantially circular cross sections, and which are individually fastened on the first and second legs 91 and 92, respectively. The pair of support beams 181 extend substantially normally, rearwardly thereof. Each of the support beams have a first end 182 which is fastened on the respective support legs 90, and an opposite, or distal second end 183. A pair of support members 184 are individually operable to support the pair of support beams 181 in predetermined, substantially parallel, spaced relationship relative to the floor panel 31. The support beams 181 are secured on the support legs 90, and the support members 184 by suitable fasteners (not shown), or by other techniques which may include welding or the like. When properly positioned, the individual support beams are disposed in predetermined, substantially parallel spaced relation relative to the platform 80.

The apparatus 10 of the subject invention includes a carriage which is generally indicated by the numeral 190 and which has a main body 191. As best seen by reference to FIG. 4, the carriage has two components, each of which are slidably mounted on the carriage support frame 180, and which are substantially identical one to the other. Therefore, for purposes of brevity, only one of the components is described in detail. The main body 191 of the carriage has opposite first and second ends 192 and 193, respectively. The main body further has a substantially longitudinally disposed channel 200 formed therein and which has a diametral dimension which is greater than the diametral dimension of the individual support beams 181. The individual channels receive bearings 200A. The individual support beams 181 are received in each of the channels and are engaged by the bearings 200A. As best recognized by a study of FIG. 10, a fastener 201 engages each component of the carriage 190. Individual torsion springs 202 are received about each of the fasteners 201 and provide a biasing force for moving a metering assembly along a predetermined path of travel which will also be discussed hereinafter. As will be recognized by a study of FIG. 10, the carriage assembly is freely moveable along a path of travel 203 from a first or rearwardly disposed position 204, to a second or forwardly disposed position 205. The operation of the carriage assembly, in combination with the metering assembly, will be discussed in the paragraphs which follow.

Figure 8:
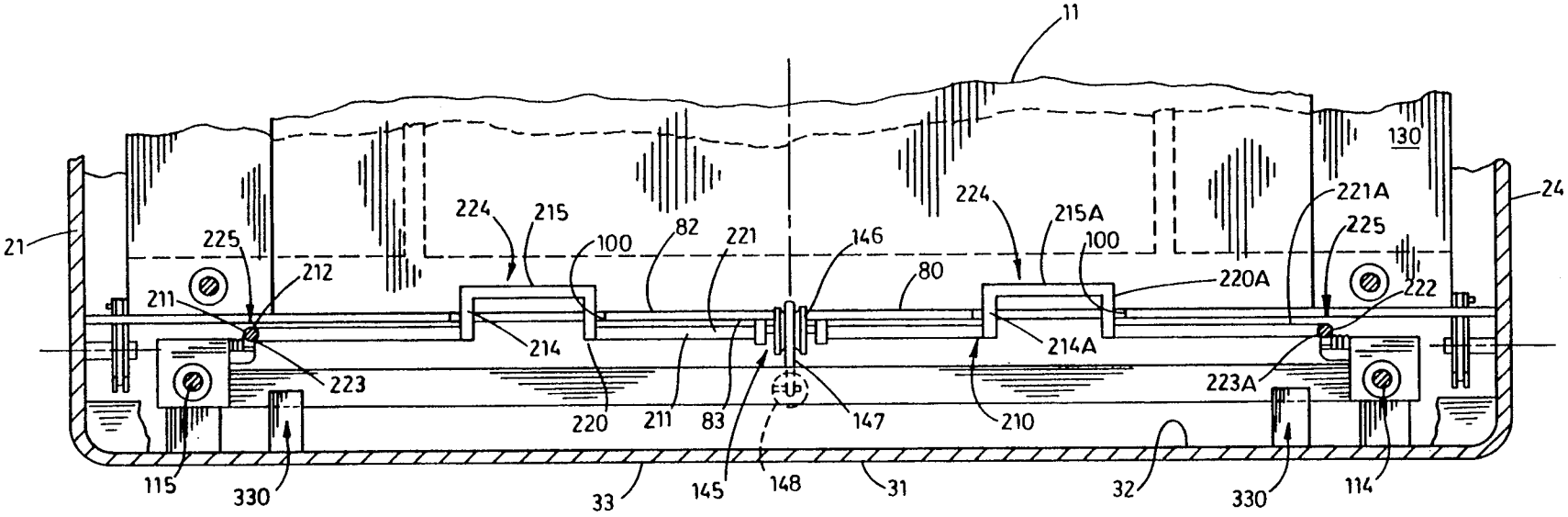
FIG. 8 is a partial, vertical, sectional view of the apparatus of the subject invention and which is taken from a position along line 8—8 of FIG. 3.

As best illustrated by reference to FIGS. 5, 10 and 11, the apparatus 10 of the subject invention includes a metering assembly which is generally indicated by the numeral 210. The metering assembly includes an elongated, generally exaggerated, "H" shaped main body 211 when this same object is viewed from FIG. 9. As best seen in FIG. 8, the metering assembly 210 is comprised of various sections which include a first, second, third, fourth, fifth, sixth, seventh and eighth sections, 212 through 223, and 214A through 221A, and 223A, respectively. Furthermore, the third, fourth, and fifth sections 213, 214 and 215; and 213A, 214A, and 215A, respectively, form a first portion 224; and the eighth sections, 223 and 223A, form a second portion 225. As will be recognized from a study of the drawings, the distal ends of sections 212 and 222 respectively, are rotatably mounted on the main body 191, of the carriage 190, and are engaged by the torsion springs 202. This physical arrangement permits the metering assembly 210 to move about a path of travel 231 from a first, occluding position 232, wherein the first portion 224 is positioned in the metering apertures 100 thereby impeding movement of the newspapers along the platform 80 and towards the passageway 45; to a second, non-occluding position 233, which permits the newspapers 11 to be moved by the rearward support assembly 112 across the platform 80 and be delivered, under the influence of gravity, and in discharging relation relative to the passageway 45. This is best illustrated by reference to FIG. 5. Following a study of FIGS. 10 and 11, it will be recognized that the individual torsion springs 202 are operable to urge the metering assembly into the first, occluding position 232. As best seen by reference to FIG. 8, the individual sections are generally disposed in substantially perpendicular relation one to the other, and the eighth section 223 and 223A are disposed in angulated relation relative to Sections 212 and 222, respectively. Further, and as best seen by reference to FIG. 10, it will be recognized that the second portion 225, of the main body 211, is disposed in force receiving relation relative to the main body 120 of the forward support assembly 111. More particularly the metering assembly 210 is mounted on, and thereby disposed in force transmitting relation relative to, the forward support assembly 111 by means of a retainer assembly which is generally indicated by the numeral 235. The retainer assembly includes a channel member 236 which encloses and secures a spring 237. The spring, in turn, is fastened on the distal end of sections 223 and 223A, respectively. The spring 237 assists the metering assembly in moving along the path of travel 231.

As will be recognized, movement of the forward support assembly 120 in a direction rearwardly of the housing 13 in order to receive or place a single newspaper 11 in sandwiched relation therebetween the forward support assembly 111, and the display assembly 37 has the effect of causing the forward support assembly to impart force upon the extreme distal end of the second portion 225 of the metering assembly 210 thereby urging the metering assembly 210 and the associated carriage assembly 190 rearwardly, and along the path of travel 203 from the second position 205, towards the first position 204. As should be understood, this movement of the carriage assembly along the path of travel 203 causes the carriage assembly to be appropriately positioned relative to the platform 80 such that the metering assembly 210 can meter newspapers 11 having substantially the same thickness dimension as the newspaper 11 which is sandwiched between the forward support assembly 11 and the display assembly 32.

As best illustrated by reference to FIGS. 5, 6, and 7, the apparatus 10 of the subject invention includes a drive assembly which is generally indicated by the numeral 240, and which includes first and second axles, 241 and 242, respectively. The first, or drive axle 241 includes opposite first and second ends 243 and 244, respectively, and is rotatably mounted in spaced relation relative to the second end 85 of the platform 80 by means of a support member (not shown), or alternatively is secured for rotational movement on the left and right panels 21 and 24 of the housing 13. As will be recognized, the means for mounting the first axle will depend upon the configuration of the apparatus 10, that is, whether the apparatus 10 is loaded or serviced through the door or display assembly 37, or alternatively through the roof panel 27, as was described earlier. The first, or drive, axle is oriented in substantially parallel relation relative to the minor axis 102. Similarly, the rear axle is borne by the housing or by support members depending upon the configuration of the apparatus 10.

Figure 7:
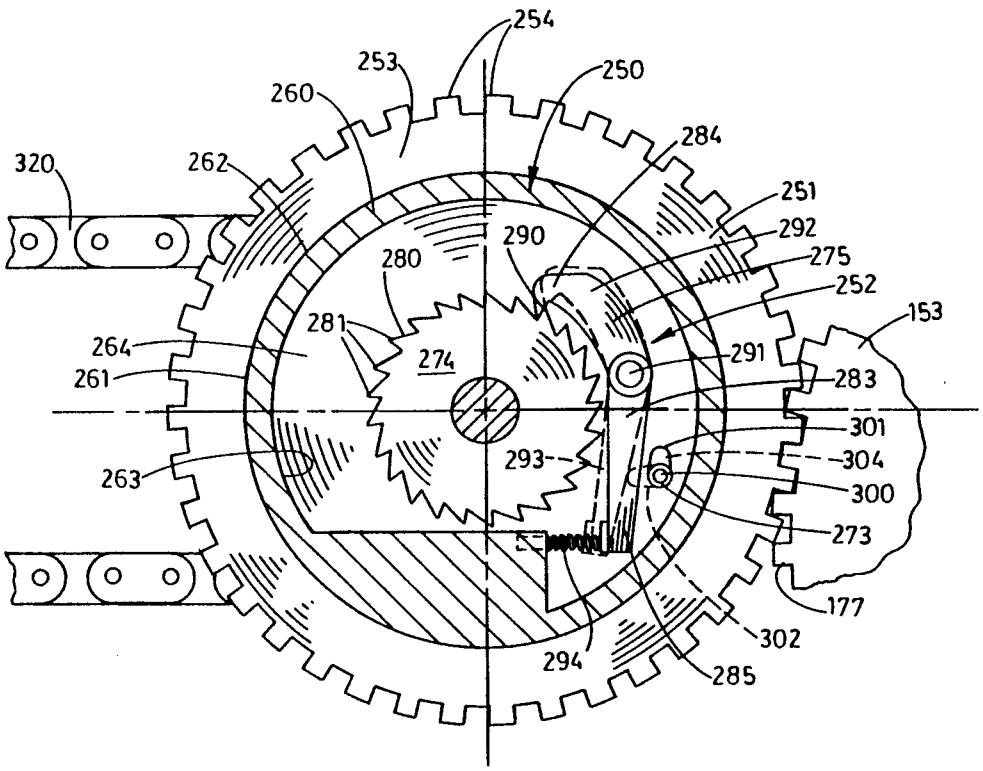
FIG. 7 is a fragmentary, vertical, sectional view of the apparatus of the subject invention and which is taken from a position along line 7—7 of FIG. 4.
Figure 6:
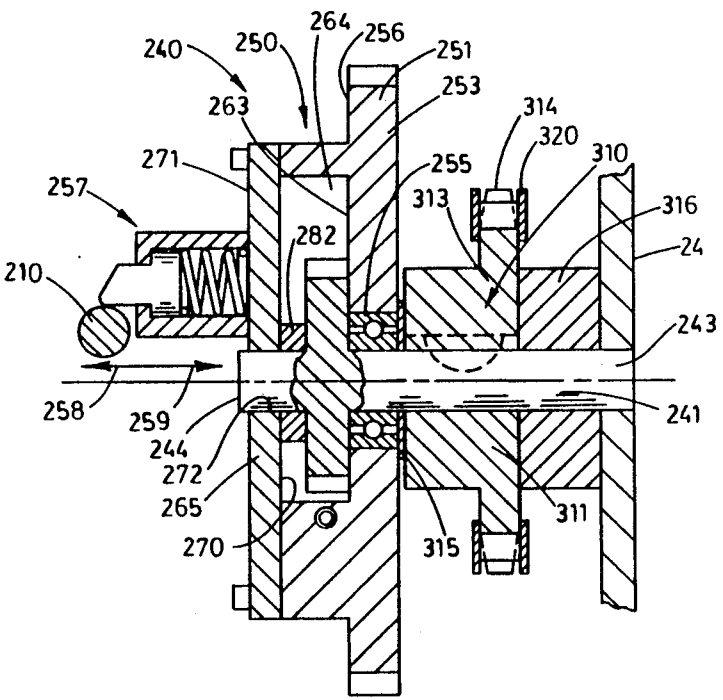
FIG. 6 is a fragmentary, vertical, sectional view of the apparatus of the subject invention and which is taken from a position along line 6—6 of FIG. 4.

As best seen in FIGS. 6 and 7, a drive gear including a pawl and ratchet assembly 250 is mounted on the second end 244, of the first, or drive axle 241. More particularly, the assembly 250 includes a drive gear 251, and a pawl and ratchet assembly which is generally indicated by the numeral 252. The drive gear 251 is of conventional design having a generally circular main body 253 which is defined by a toothed peripheral edge 254. The circular main body 253 is rotatably mounted on the first drive axle 241 by means of a bearing 255. The bearing 255 is of conventional design and is operable to be received, as by a friction fit, on the first drive axle 241, and is further received in an aperture formed in the circular main body 253. Therefore, and during operation, the bearing 255 permits the drive gear 251 to freely rotate about the first drive axle 241. The drive gear further includes an interior facing surface 256. Positioned in spaced relation relative to the interior facing surface of the gear is a spring biased metering assembly engagement member 257. The engagement member 257 is moveable along a path of travel from a first, force transmitting position 258 to a second, disengaged position 259. As should be understood, and upon rotation of the gear, under the influence of the actuator 150, the engagement member 257 moves into force engaging relation relative to the metering assembly 210 thereby urging it along the path of travel 231 from the first, occluding position 232, to the second, non-occluding position 233. The operation of the engagement member will be discussed in greater detail hereinafter. As best seen in FIG. 7, a housing 260 is made integral with the circular main body 253 of the gear. The housing includes a wall 261, which has an exterior facing surface 262, and an opposite interior facing surface 263. The interior facing surface 263 defines an operating cavity 264 within which the pawl and ratchet assembly 250 is enclosed. A cover plate 265, which has an interior facing surface 270, and an exterior facing surface 271 substantially occludes the operating cavity 264. As illustrated in FIG. 5, the engagement member 257 is fixed on the cover plate as by welding or other suitable fastening techniques. An aperture 272 is formed in the cover plate and is operable to accommodate the second end 244, of the axle 241. Further, an aperture 273 is formed in the cover plate and accommodates a pawl disengagement member which will be discussed in greater detail, hereinafter.

As best illustrated by reference to FIG. 7, the pawl and ratchet assembly 250 includes a ratchet wheel 274 and a pawl 275. The ratchet wheel 274 has a predetermined shape which is defined by a peripheral edge 280, and which has a plurality of teeth 281 formed therein. The ratchet wheel 274 is fixed on, or otherwise made integral with, the first drive axle 241, and is disposed for rotatable motion in the operating cavity 264 at a predetermined distance from the interior cover plate surface 270. The ratchet wheel is separated by a washer 282 from the cover plate. The pawl 275 includes a main body 283 having a first end 284, and a second end 285. Formed on the first end 284 is a drive tooth 290 which is operable to engage the individual teeth 281 of the ratchet wheel 274. As should be understood, the main body of the pawl is pivotally mounted on the interior facing surface 263, and within the operating cavity 264 by a means of a pin 291. The pin 291 defines an axis of rotation about which the pawl reciprocally pivots during operation from a first, ratchet wheel engaged position 292, to a second, ratchet wheel disengaged position 293. A biasing means, herein illustrated as a compression spring 294, is fixed or positioned on the interior facing surface 263, and biasedly engages or otherwise imparts force to the second end 285 of the pawl thereby urging the drive tooth into the first ratchet wheel engaged position 292. In addition to the foregoing, the housing 260 movably supports a pawl disengagement member 300 which is operable to selectively position the first end of the pawl in the second, ratchet wheel disengaged position. More particularly, the pawl disengagement member is operable to travel from a first position 301 wherein the pawl disengagement permits the first end of the pawl to remain in the first ratchet wheel engaged position 292, to a second position 302, wherein the pawl disengagement member drives the first end of the pawl into the second, ratchet wheel disengaged position 293. The pawl disengagement member has a hand manipulatable member 304 which extends through the aperture 273 which is formed in the cover plate 265.

Figure 3:
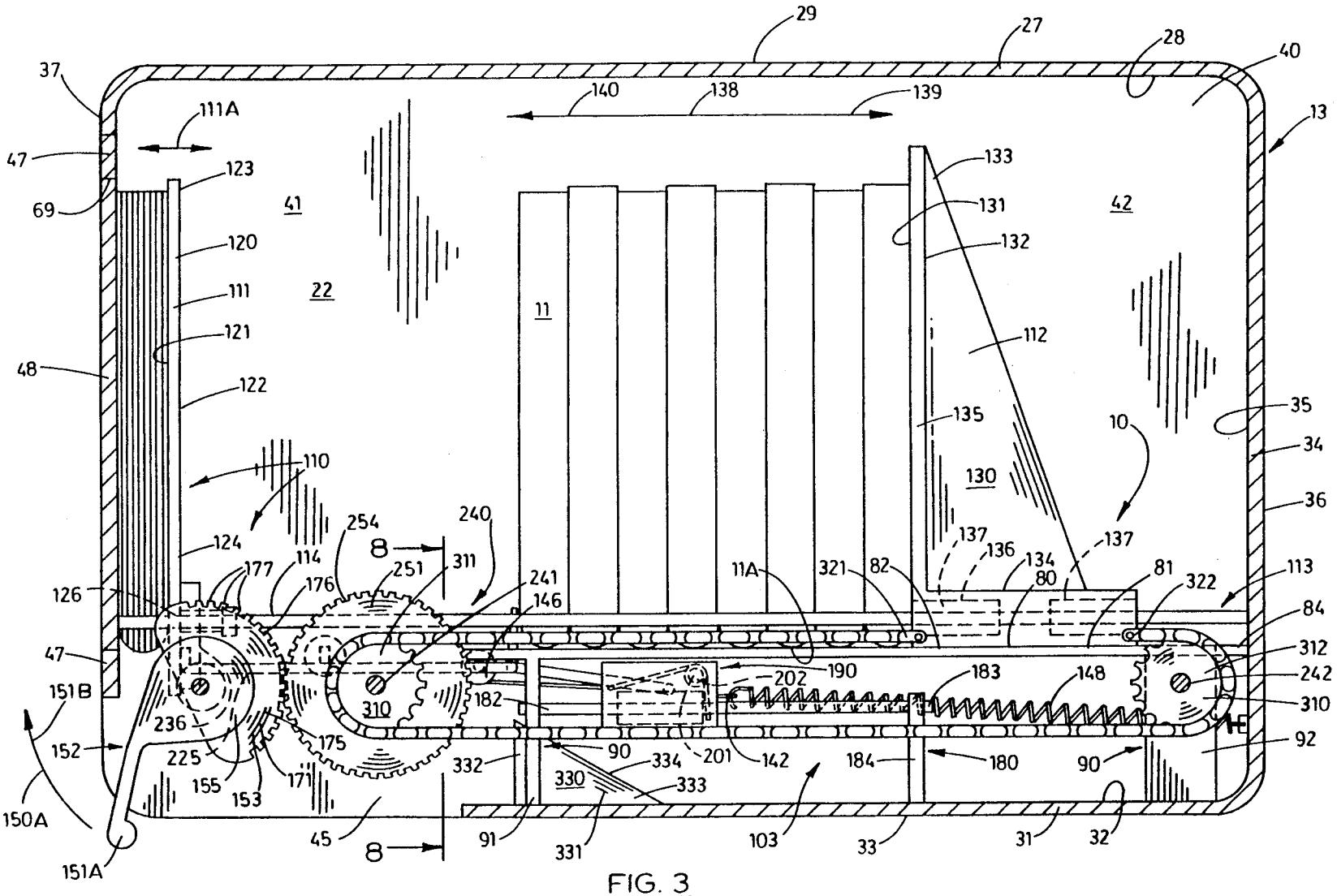
FIG. 3 is a right, partial, vertical, sectional view of the apparatus of the subject invention and which is taken from a position along line 3—3 of FIG. 1.

As should be understood by a comparative study of FIGS. 3, 4, and 9, the pawl and ratchet assembly 250 are operable, in combination, to transmit force to the first drive axle 241, and are also operable to permit the actuator 150 to return from the second, vend position 151B, to the first, non-vend position 151A during operation. More particularly, the toothed surface 254 of the drive gear 251 is disposed in force receiving relation relative to the teeth 177 of the actuator drive portion 153. Therefore, rotational movement of the actuator 150 from the first, non-vend position 151A, to the second, vend position 151B imparts a corresponding counterclockwise rotational movement to the drive gear 251. Rotation of the drive gear in the counterclockwise direction causes the pawl 275 to engage the ratchet wheel 274 thereby urging it in the counter-clockwise direction. Further, rotation of the ratchet wheel imparts a similar rotational movement to the first, or drive axle 241. Conversely, and when the actuator 150 is caused to return to the first, non-vend position 151A, from the second vend position 151B, the drive gear is rotated in the opposite, clockwise direction by the actuator thereby causing the pawl to rotate, or otherwise slip over the peripheral edge 280 of the ratchet wheel 274 in the ratchet wheel disengaged position 293, whereby the actuator returns to the first non-vend position 151A. In operation, the pawl disengagement member 300 moves the pawl 275 into the second position 302 thereby permitting the rearward support assembly to be moved by an operator along the path of travel 138 from the second position 140 to the first position 139. This is necessary when the apparatus 10 is being reloaded with newspapers 11.

As best depicted by reference to FIG. 9, a pair of sprockets 310 are individually mounted on the first end 243 of the first and second axles 241 and 242, respectively. Each of the sprockets are fixed on the respective axles by utilizing conventional fastening techniques. The pair of sprockets are identified, hereinafter, as first and second sprockets 311 and 312, respectively. The respective sprockets have a main body 313 which has a plurality of teeth 314 disposed about their respective peripheral edges. As best seen by reference to FIG. 6, a spacer, or washer which is generally indicated by the numeral 315, is disposed between the first sprocket 311, and the drive gear 251. Further, a spacer 316 positions the first sprocket in spaced relation relative to the right panel 24 of the housing 13. As best illustrated by reference to FIG. 9, a drive chain 320, of conventional design, is received about the first and second sprockets. The drive chain has a first end 321 and an opposite second end 322. As best seen in FIG. 3, the first and second ends of the chain are affixed on the rearward support assembly 112 thereby providing a means by which rotation of the axle assemblies imparts motive force to the rearward support assembly thereby driving it in a predetermined direction, and in spaced relationship relative to the platform 80. As best seen in FIGS. 4 and 9, the apparatus 10 includes a pair of idler sprockets 323 which are rotatably fixed on the left panel 21. A second chain 324 is received about the idler sprockets and is further attached on the rearward support assembly.

Figure 10:
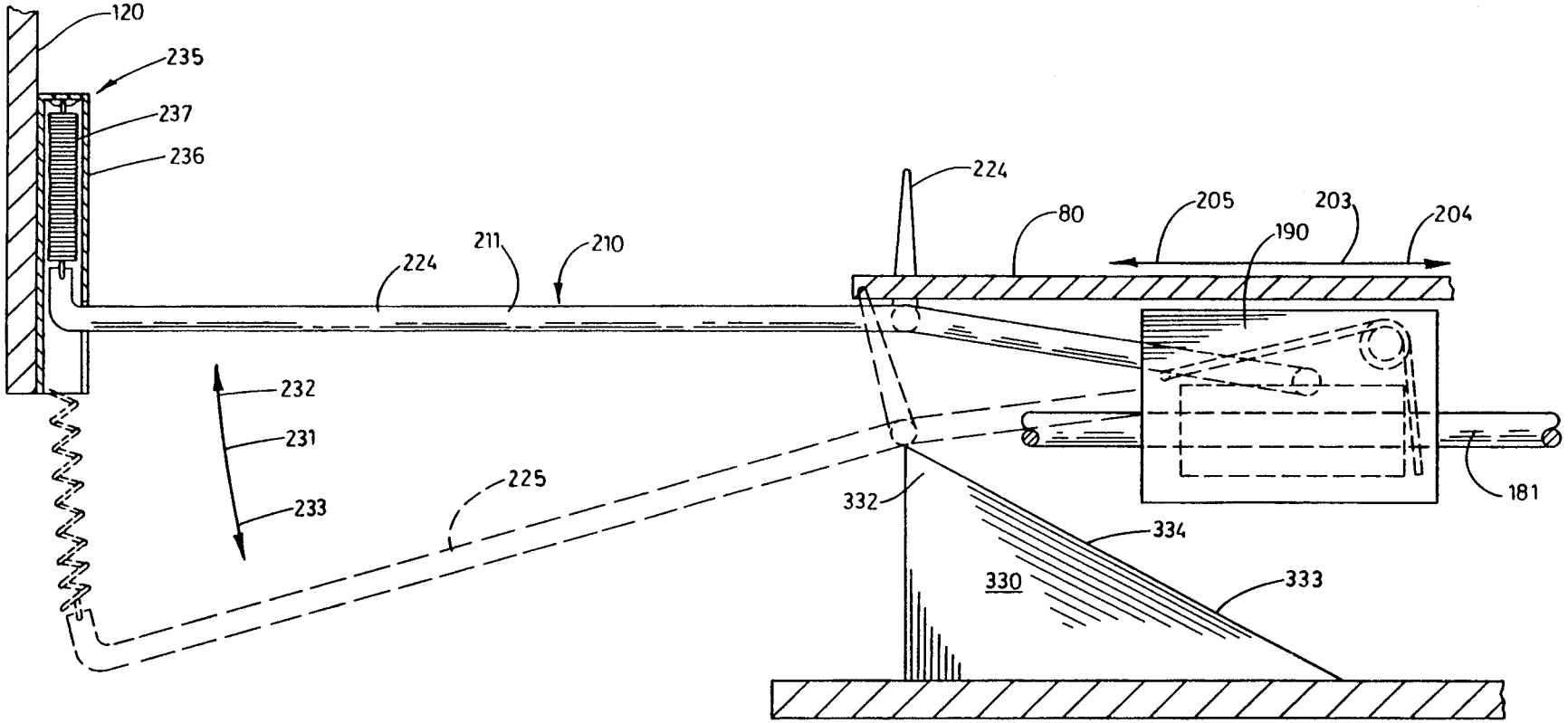
FIG. 10 is a fragmentary, side elevational view of the metering assembly of the present invention with many supporting surfaces removed to illustrate the structure and operation thereof.
Figure 11:
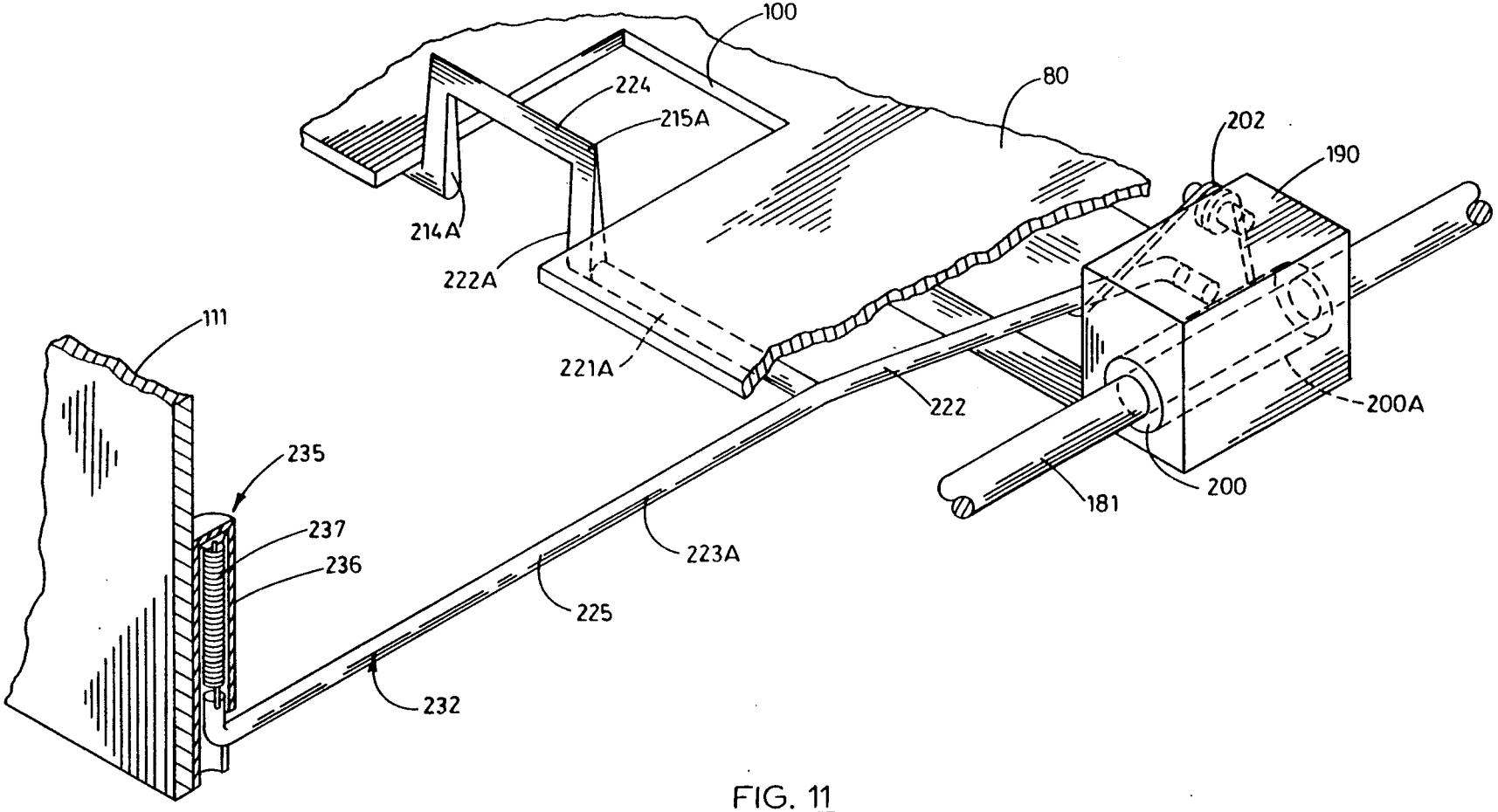
FIG. 11 is a fragmentary, perspective view of the metering assembly of the present invention with many supporting surfaces removed to illustrate the structure thereof.

As best seen by reference to FIGS. 5 and 10, respectively, a movement limiting member 330 is fixed in a predetermined position on the floor panel 31 and disposed in movement impeding relation relative to the metering assembly 210. The movement limiting member 330 has a main body 331 which has a first end 332, and a second end 333. Further, the main body defines an upwardly disposed surface 334 which is oriented in angulated relationship relative to the floor panel 31. As should be understood, and upon movement of the metering assembly 210 along the path of travel 231 from the first, occluding position 232 to the second, non-occluding position 233, the metering assembly 210 will eventually engage the movement limiting member 330, (FIG. 5). When this event occurs, continued motion of the actuator 150 from the non-vend position, 151A, to the vend position, 151B, causes sufficient force to be exerted such that the metering assembly engagement member 257 moves from the first, force transmitting position 258 to the second, disengaged position 259, (FIG. 6). When this event occurs, the metering assembly 210, under the influence of the torsion springs 202, travels along the path of travel 231, from the second, non-occluding position 233, to the first, occluding position 232, (FIG. 10).

The movement limiting member 330 is operable to permit the metering assembly 210 to travel increasing distances, as the thickness of the newspaper 11 increases. As should be understood, increasing distances are required to permit the rearward support assembly 112 to move a sufficient distance to vend a single relatively thick newspaper from the apparatus. Therefore, and when a relatively thin newspaper is being vended, the length of the path of travel 231 for the metering assembly 210 is generally short. In this regard, it should be recognized that when a thin newspaper is being vended, the forward support assembly 111 is located in a position which is quite close to the display assembly 37 thereby locating the carriage 190 in its most forward position along the path of travel 203. Consequently, and upon vending a thin newspaper, the path of travel for the metering assembly 210 is quite short, that is, the metering assembly 210 comes into contact with that area of the movement limiting member 330 near the first end 332, of the main body 331. In the alternative, and when a thick newspaper is being vended, the forward support assembly 111 urges the carriage assembly 190 rearwardly along the path of travel 203, and towards the second position 205 thereby permitting the metering assembly 210 to travel an increased distance along the path of travel 231 before coming into contact with the movement limiting member 330. This point of contact will occur between the first end 332 and the distal, second end 333. Therefore, the movement limiting member 330 provides a convenient and expeditious means by which the present apparatus may be automatically adjusted for newspapers having various thickness dimensions.

OPERATION

The operation of the described embodiment of the present invention is believed to be readily apparent and is briefly summarized at this point. The apparatus 10 of the subject invention is operable to sequentially vend a plurality of newspapers 11 or the like. More particularly, the apparatus includes a housing 13 which defines a cavity and which encloses the plurality of newspapers. The newspapers, are individually defined by respective length, width, and thickness dimensions. The housing further defines a passageway 45 which permits the individual newspapers to pass from the housing. As earlier discussed, a display assembly and which is generally indicated by the numeral 37, is borne by the housing and provides a convenient means by which a person may see into the apparatus. A platform 80 is received in the cavity 40 which is defined by the housing, and is operable to support the plurality of newspapers. A rearward support assembly 112 is slidably borne by the housing and movable along a path of travel 138 and in spaced relationship relative to the platform 80 to urge the newspapers in the direction of the passageway. A forward support assembly 111 is movably borne by the housing and operable to hold one newspaper against the display assembly 37 for viewing from a position outside the housing. A carriage assembly 190 is slidably borne by the platform 80 and is operable for movement along a path of travel 203. A spring-biased metering assembly 210 is mounted for pivotable movement on the carriage assembly 190 and is operable for movement along a path of travel 231 from a first position 232, wherein the metering assembly is disposed in occluding relation relative to the passageway 45 thereby substantially inhibiting movement of the newspapers 11 towards the passageway, to a second position 233, wherein the metering assembly 210 is disposed in substantially non-occluding position relative to the passageway 45. The spring-biased metering assembly is biased into the first position 231 by the torsion springs 202. As earlier discussed, the placement of one newspaper in sandwiched relation between the display assembly 37, and the forward support assembly 111 locates the carriage assembly 190 in a predetermined position along the path of travel 203. The apparatus 10 further includes a movement limiting member 330 which is disposed in movement impeding relation relative to the spring-biased metering assembly 210. An actuator 150 is borne by the housing and is operable for movement along a path of travel 150A from a first, or non-vend position 151A, to a second, or vend position 151B. The apparatus 10 further includes a drive assembly 240 which is borne by the housing and disposed in force receiving relation relative to the actuator 150, and in driving relation relative to the rearward support assembly 12 and the spring-biased metering assembly 210, respectively. The drive assembly is operable to simultaneously drive the rearward support assembly 112 along the path of travel 138 towards the passageway 45, and drive the spring-biased metering assembly 210 along the path of travel 231 from the first, occluding position 232 to the second, non-occluding position 233 by means of the metering assembly engagement member 257. As should be understood, and when the spring-biased metering assembly comes into contact with the movement limiting member, continued movement of the actuator 150 towards the vend position 151B causes the engagement member 257 to move from the first, force transmitting position 258, to the second disengaged position 259. This movement of the engagement member disengages the drive assembly from the metering assembly thereby allowing the spring-biased metering assembly to move from the second position 233, to the first, occluding position 232, under the influence of the torsion springs 202.

As earlier discussed, the apparatus 10 is self-adjusting with respect to the specific newspapers 11 being vended. In particular the apparatus 10 provides a convenient means whereby the apparatus 10 is properly adjusted by merely positioning one newspaper in sandwiched relation between the display assembly 37 and the forward support assembly 111. When this event occurs, the forward support assembly urges the carriage assembly 190 rearwardly of the housing 13 and into an appropriate position for the metering assembly 210 to meter newspapers 11 having approximately the same thickness dimension. Further, the movement limiting member has a predetermined shape which permits the metering assembly 210 to travel increasing distances along the path of travel 231 as the thickness of the newspaper positioned between the display assembly 37 and the forward support assembly 111 increases.

The actuator 150, acting in combination with the drive assembly 240, is operable to cause the newspapers 11 to move along the platform 80. In particular, the actuator 150 is rotatably mounted on the housing 13 and is operable for movement along a path of travel which substantially coincides with the path of travel 150A. The actuator is movable from a first, non-vend position 151A to a second, vend position 151B. The actuator includes a handle portion 152 upon which force is applied by a customer; and a drive portion 153 which engages the drive gear 251. When the actuator moves from the non-vend position 151A to the vend position 151B, force is transmitted through the first axle 241, first and second sprockets 311, and 312, and through the drive chain 320 thereby urging the rearward support assembly 112 along the path of travel 138 towards the passageway 45.

As earlier discussed, to initiate a vending cycle, appropriate coinage would need to be inserted in a state-of-the-art coin deposit assembly 66, thereby permitting the actuator to move along the path of travel 150A. The coin deposit assembly, however, does not constitute an integral part of the present invention but is well understood by those skilled in the art.

Therefore, the apparatus 10 of the subject invention can be employed in a wide variety of operative environments, can be manufactured and purchased at a moderate cost when compared with related prior art devices, is highly efficient in operation and is compact, thereby facilitating its utilization and maintenance and is further designed in a fashion whereby it reduces to an absolute minimum, the assorted problems associated with many of the prior art devices which are designed for substantially identical purposes.

Although the present invention has been herein shown and described and what is conceived to be the most practical and preferred embodiment, it is recognized that departures may be made therefrom within the scope of the invention which is not to be limited to the illustrated details disclosed.

Having described my new invention what I claim as new and desire to secure by letters patent of the United States is:

1. A dispensing apparatus for vending articles comprising:

a platform for supporting the articles to be vended;

a rearward support assembly slidably mounted in spaced relation relative to the platform and operable to urge the articles in a predetermined direction along the platform;

a carriage assembly movably borne by the platform;

a metering assembly pivotally borne by the carriage assembly and operable for movement from a first position, wherein the metering assembly substantially inhibits movement of the articles along the platform, to a second position wherein the metering assembly permits the articles to advance along the platform;

an actuator disposed in force transmitting relation relative to the platform;

a movement limiting member disposed in movement impeding relation relative to the metering assembly; and a drive assembly disposed in force receiving relation relative to the actuator and in driving relation relative to the rearward support assembly and metering assembly respectively, the drive assembly simultaneously urging the rearward support assembly along the platform, and the metering assembly from the first to the second positions, thereby vending a single article.

2. A dispensing apparatus as claimed in claim 1 and wherein the platform is enclosed within a housing which includes a display assembly, and wherein a forward support assembly is slidably borne by the housing and disposed in force transmitting relation relative to the metering assembly, and wherein the forward support assembly, and display assembly positions one of the articles in an orientation where it may be viewed from a position outside the housing, the article being sandwiched between the display assembly, and the forward support assembly, and wherein the forward support assembly causes the carriage to be positioned in a location relative to the platform which is appropriate for the metering assembly to meter articles having approximately similar dimensions.

3. A dispensing apparatus as claimed in claim 2, and wherein the metering assembly has first and second portions, and wherein the first portion is operable to impede movement of the articles along the platform, and wherein the second portion is disposed in force receiving relation relative to the forward support assembly, and wherein a spring is borne by the carriage and is operable to bias the metering assembly toward the first position.

4. A dispensing apparatus as claimed in claim 3, and wherein the drive assembly includes a drive gear which is borne by the housing and which is disposed in force receiving relation relative to the actuator, and wherein a metering assembly engagement member is borne by the drive gear and disposed in force transmitting relation relative to the second portion of the metering assembly, and wherein the actuator is operable to move from a non-vend position to a vend position, and wherein movement of the actuator from the non-vend position to the vend position urges the metering assembly engagement member into force transmitting relation relative to the metering assembly thereby causing the metering assembly to move from the first to the second positions.

5. A dispensing apparatus as claimed in claim 4 and wherein the movement limiting member is borne by the housing, and wherein during movement of the actuator from the non-vend to the vend positions, the metering assembly moves into engagement with the movement limiting member, and wherein continued movement of the actuator towards the vend position causes the metering engagement member to disengage from the metering assembly, and wherein the metering assembly under influence of the spring moves from the second to the first position.

6. A dispensing apparatus as claimed in claim 5 and wherein the drive assembly includes a ratchet and pawl assembly which is disposed in force transmitting relation relative to the drive gear.

7. A dispensing apparatus for sequentially vending a plurality of newspapers or the like comprising:

a housing defining a cavity, and which encloses the plurality of newspapers, and wherein the newspapers are individually defined by respective length, width and thickness dimensions, and wherein the housing further defines a passageway which permits individual newspapers to pass from the housing;

a display assembly borne by the housing;

a platform borne by the housing and disposed within the cavity, the platform operable to support the plurality of newspapers;

a rearward support assembly slidably borne by the housing and movable along a first path of travel to urge the newspapers in the direction of the passageway;

a forward support assembly movably borne by the housing and operable to hold one newspaper against the display assembly for viewing from a position outside the housing;

a carriage assembly slidably borne by the platform and operable for movement along a second path of travel;

a spring biased metering assembly mounted for pivotable movement on the carriage assembly and operable for movement along a third path of travel from a first position, wherein the metering assembly is disposed in occluding relation relative to the passageway thereby substantially inhibiting movement of the newspapers toward the passageway, to a second position, wherein the metering assembly is disposed in a substantially non-occluding position relative to the passageway, and wherein the spring biased metering assembly is biased into the first position, and wherein the metering assembly is disposed in force receiving relation relative to the forward support assembly, and wherein the placement of the one newspaper in sandwiched relation between the display assembly and the forward support assembly locates the carriage assembly in a predetermined position along the second path of travel;

a movement limiting member borne by the housing and disposed in movement impeding relation relative to the spring biased metering assembly;

an actuator movably mounted on the housing and operable for movement along a fourth path of travel from a first or non-vend position, to a second, vend position; and a drive assembly borne by the housing and disposed in force receiving relation relative to the actuator, and in driving relation relative to the rearward support assembly, and spring biased metering assembly, respectively, and wherein the drive assembly is operable to simultaneously drive the rearward support assembly along the first path of travel toward the passageway, and drive the spring biased metering assembly along the third path of travel from the first, occluding position, to the second non-occluding position upon movement of the actuator from the first non-vend position to the second vend position, and wherein engagement of the spring biased metering assembly with the movement limiting member causes the drive assembly to disengage from the spring biased metering assembly thereby allowing the spring biased metering assembly to move from the second position to the first position.

8. A dispensing apparatus as claimed in claim 7 and wherein the positioning of a newspaper in sandwiched relation between the display assembly, and forward support assembly, positions the carriage in a location relative to the platform which is appropriate for the metering assembly to meter newspapers having approximately the same thickness dimension.

9. A dispensing apparatus as claimed in claim 8 and wherein the metering assembly has first and second portions, and wherein the first portion is disposed in movement impeding relation relative to the individual newspapers, and wherein the second portion of the metering assembly is disposed in force receiving relation relative to the forward support assembly, and wherein the movement limiting member has a predetermined shape which permits the metering assembly to travel increasing distances along the third path of travel as the thickness of the newspaper positioned between the display assembly, and the forward support assembly increases.

10. A dispensing apparatus as claimed in claim 9, and wherein the drive assembly includes first and second axle assemblies which are borne by the housing and disposed in substantially parallel, space relation one to the other, and wherein the axle assemblies further have opposite first and second ends, and wherein the dispensing apparatus further includes first and second sprockets which are individually mounted on the first end of each of the axle assemblies, and wherein a drive chain is disposed in driving relation about the first and second sprockets, and the rearward support assembly is fixed on the drive chain, and wherein a drive gear including a ratchet and pawl assembly, and a metering assembly engagement member are also mounted on the first end of the first axle assembly and disposed in force receiving relation relative to the actuator, and wherein movement of the actuator from the first, non-vend position to the second, vend position simultaneously imparts rotational movement to the first and second axle assemblies by means of the ratchet and pawl assembly thereby urging the rearward support assembly toward the passageway, and moves the metering engagement member into force transmitting relation relative to the metering assembly thereby urging the metering assembly along the third path of travel from the first position to the second position.

11. A dispensing apparatus as claimed in claim 10 and wherein the metering engagement member includes a main body which is biased into a first, force transmitting position, but which is movable along a path of travel to a second, disengaged position, and wherein the main body is operable to engage the second portion of the metering assembly.

12. A dispensing apparatus for vending articles comprising:

a platform for supporting the articles to be vended;

a display assembly disposed adjacent to the platform;

a forward support assembly disposed between the platform and the display assembly, and wherein the forward support assembly is biased in the direction of the display assembly, and wherein a single article to be vended is disposed in sandwiched relation between the display assembly and the forward support assembly;

a rearward support assembly slidably mounted above the platform and operable to urge the articles along the platform;

a carriage assembly movably borne by the platform;

a metering assembly pivotally mounted on the carriage assembly and operable for movement along a path of travel from a first position, wherein the metering assembly substantially inhibits movement of the articles along the platform, to a second position wherein the metering assembly permits the articles to advance along the platform, and wherein the metering assembly is disposed in force receiving relation relative to the forward support assembly, and wherein the positioning of a single article between the display assembly, and the forward support assembly positions the carriage assembly in an appropriate location relative to the platform to permit the metering assembly to meter articles having substantially the same thickness dimension;

an actuator disposed in force transmitting relation relative to the platform;

a movement limiting member disposed in movement impeding relation relative to the metering assembly, and wherein the movement limiting member has a predetermined shape which permits the metering assembly to travel increased distances along the path of travel as the thickness of the article vended increases; and a drive assembly disposed in force receiving relation relative to the actuator, and in force transmitting relation relative to the rearward support assembly, and the metering assembly, respectively, the drive assembly under the influence of the actuator simultaneously urging the rearward support assembly along the platform and the metering assembly from the first to the second position thereby vending a single article.

* * * * *